US006515642B1

(12) United States Patent
Lin

(10) Patent No.: US 6,515,642 B1
(45) Date of Patent: Feb. 4, 2003

(54) DRIVING CIRCUIT FOR A LIQUID CRYSTAL DISPLAY

(75) Inventor: Vincent Lin, Taipei (TW)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/417,683

(22) Filed: Oct. 14, 1999

(51) Int. Cl.[7] ..... G09G 3/36
(52) U.S. Cl. ..... 345/87; 345/92
(58) Field of Search ..... 345/211, 212, 345/213, 87, 89, 94, 99, 98

(56) References Cited

U.S. PATENT DOCUMENTS 5,869,999 A * 2/1999 Mawet ..... 330/253
6,008,669 A * 12/1999 Gerner ..... 326/87
6,057,819 A * 5/2000 Sone et al. ..... 345/96
6,118,415 A * 9/2000 Olson ..... 345/41
6,124,843 A * 9/2000 Kodama ..... 345/145
6,201,517 B1 * 3/2001 Sato ..... 345/7

* cited by examiner

*Primary Examiner*—Vijay Shankar
*Assistant Examiner*—Nitin Patel
(74) *Attorney, Agent, or Firm*—Samuels, Gauthier & Stevens

(57) ABSTRACT

This invention relates to a driving circuit for a liquid crystal display, comprising a plurality of dynamic controllers, each dynamic controller including the integration of an operating amplifier, a Schmitt comparator and a plurality of transistors acting as switches.

5 Claims, 5 Drawing Sheets

DRIVING CIRCUIT FOR A LIQUID CRYSTAL DISPLAY

BACKGROUND OF THE INVENTION

1. Field of the Invention

This invention relates for a driving circuit for a liquid crystal display, and more particularly, to a dynamic controller located in a driving circuit for a liquid crystal display to stabilize the supply voltage.

2. Description of Prior Art

For a small-scale liquid crystal display of a liquid crystal device such as a watch, a timer and a meter, a plurality of common signals in the horizontal axis are inter-connected with a plurality of segment signals in the vertical axis. The voltage levels of the common signals and the segment signals are each divided into several predetermined voltage levels, such as Vdd, VL1, VL2 and VL3, as shown in FIG. 1. Taking the example of the voltage levels of Vdd, VL1, VL2 and VL3, Vdd is a voltage pair of VL2. Likewise, VL1 is a voltage pair of VL3. By the operation of opening or closing several analog switches in FIG. 1, corresponding liquid crystal cells of the liquid crystal display will be respectively polarized or not polarized by changing the parasitic capacitors in the liquid crystal display. In the upper portion of FIG. 1, the upper input voltage level of the parasitic capacitor is controller by the common signals via the analog switches, and, in the lower portion of FIG. 1, the input voltage of the parasitic capacitor is controller by the segment signals via the analog switches. A frame frequency, shown in FIG. 2, is constructed by a negative cycle where the valid input voltage levels of the segment signals are all negative and by a positive cycle where the valid input voltage levels of the segment signals are all positive. The common signals can be regarded as being scanned in a manner as follows. In the negative cycle of the frame frequency, the common signals are switched between Vdd and VL2, and in the positive cycle of the frame frequency, the common signals are switched between VL1 and VL3. In the negative cycle, the common signal with the voltage level Vdd means that the common signal is being scanned. In the positive cycle, the common signal with the voltage level VL3 means that the common signal is being scanned. The voltage difference between the common signal and the segment signal at the moment will determine the voltage difference of the liquid crystal cell. As shown in FIG. 2, there are four common signals, and hence each portion of the negative and positive cycle of the frame frequency is divided into four pieces. In each divided cycle of the negative cycle, if the segment signal of the scanned common signal is VL3, since the voltage difference between the common signal and the segment signal is large, the liquid crystal cell will be turned on. In the same manner, in each divided cycle of the positive cycle, if the segment signal of the scanned common signal is Vdd, since the voltage difference between the common signal and the segment signal is large, the liquid crystal cell will be turned on. Otherwise, the liquid crystal cell will be turned off By multiplexing the liquid crystal cell to different voltage levels, the varied levels will cause the problem of floating the input voltage of the liquid crystal cell. The conventional solution for solving this problem is to provide a capacitor connected between the corresponding input level and the ground, as shown in FIG. 3, for achieving the goal of raising the voltage level and further stabilizing the voltage level. However, the installation of the capacitors will result in the problems of having too many pins for the integrated circuit, the area need for the integral layout being too large, and causing the trouble for preparing the capacitors. Another conventional solution for the varied voltage level is to construct a divided circuit by setting a plurality of resistors. As shown in FIG. 4, a plurality of resistors are biased between the drain supply voltage, Vdd, and the source supply voltage. Each interconnection point between two conjunct resistors derives an individual voltage level. The driving voltage level of the liquid crystal display is combined by these derived voltage levels and the drain supply voltage level. This conventional driving circuit has the drawback of consuming a large current, and of the area driven by the driving circuit being limited, for example, 10 $\mu$A to drive the area of 5 cm×2 cm of the liquid crystal display.

SUMMARY OF THE INVENTION

The object according to this invention is to overcome the drawbacks of the two conventional driving circuits for the liquid crystal display by constructing a plurality of dynamic controllers in a driving circuit for a liquid crystal display. The dynamic controller according to this invention is able to eliminate the necessity of the installation of the external capacitors for the conventional driving circuit and significantly reducing the driving current for the driving circuit. Also, the dynamic controller can drive a much larger area for a liquid crystal panel. The power saving function according to this invention is achieved by timely emitting the power-on signal once at the moment before and after each of the common signals is to be scanned so as to properly enable the Schmitt comparator.

Each dynamic controller of the driving circuit for the liquid crystal display in this invention is to keep the input voltage level steady in such a manner that when the output voltage of the dynamic controller is too large, the sink current in the dynamic controller will lower the output voltage level, and when the output voltage of the dynamic controller is too small, the Schmitt comparator in the dynamic controller will raise the output voltage level.

DETAILED DESCRIPTION OF THE PREFERRED EMBODIMENT

Figure 1:
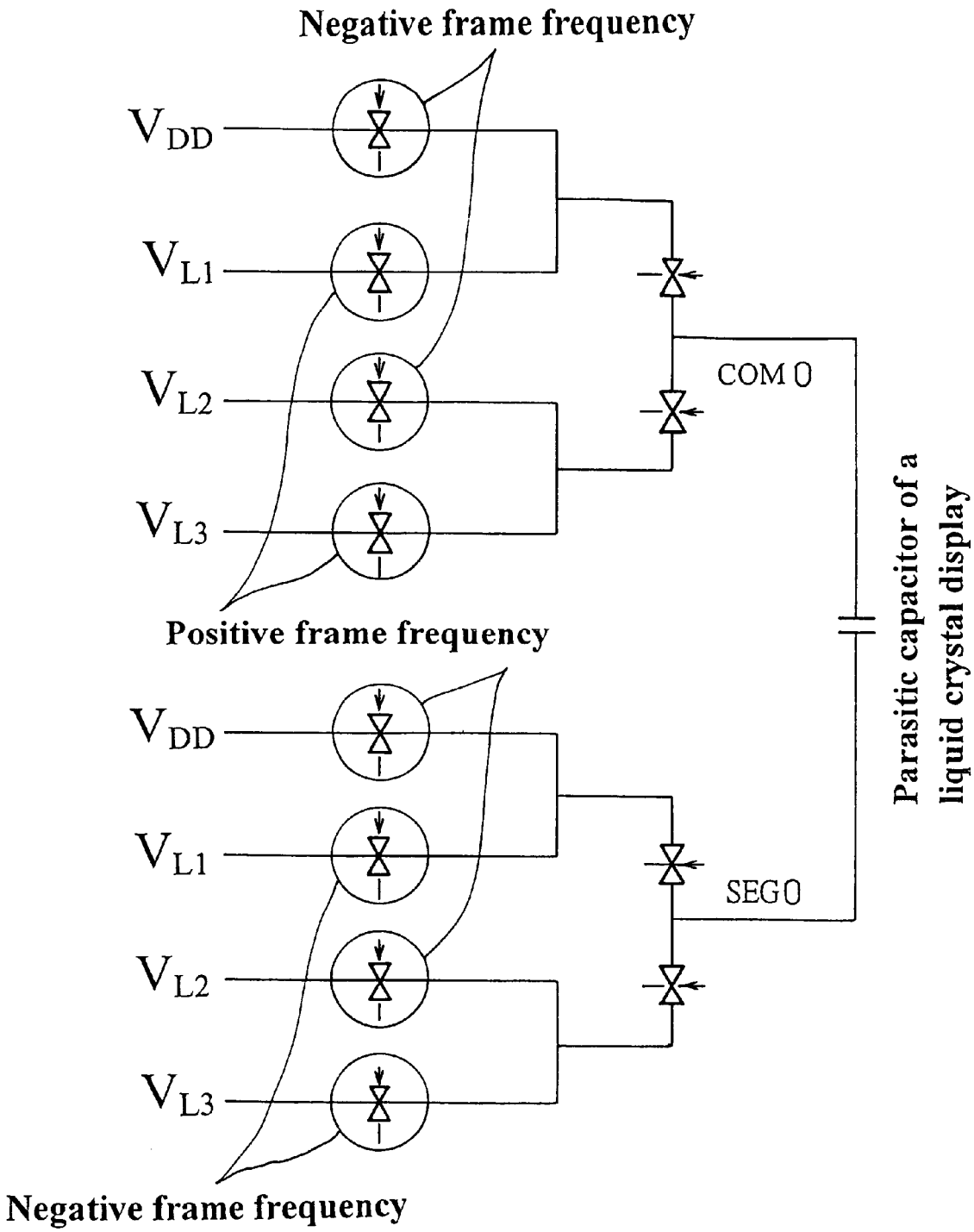
FIG.1 (PRIOR ART)
FIG. 1 shows a conventional configuration of the common signals, segment signals, divided voltage levels and liquid crystal cells.
Figure 2:
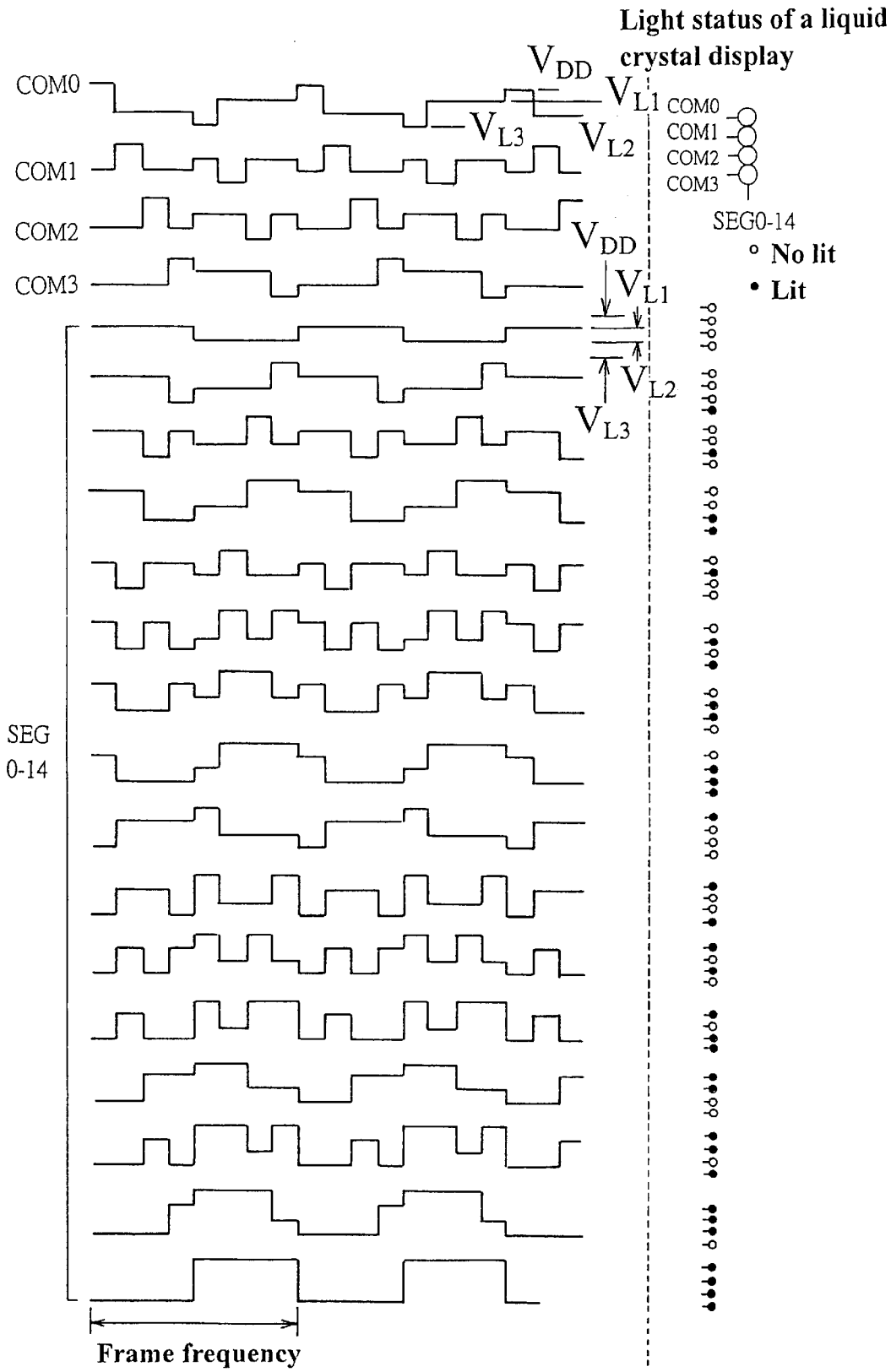
FIG.2(PRIOR ART)
FIG. 2 is a timing diagram for the common signals and the segment signals of the prior art.

By referring to the drawings, a preferred embodiment according to this invention will be described as follows.

Figure 3:
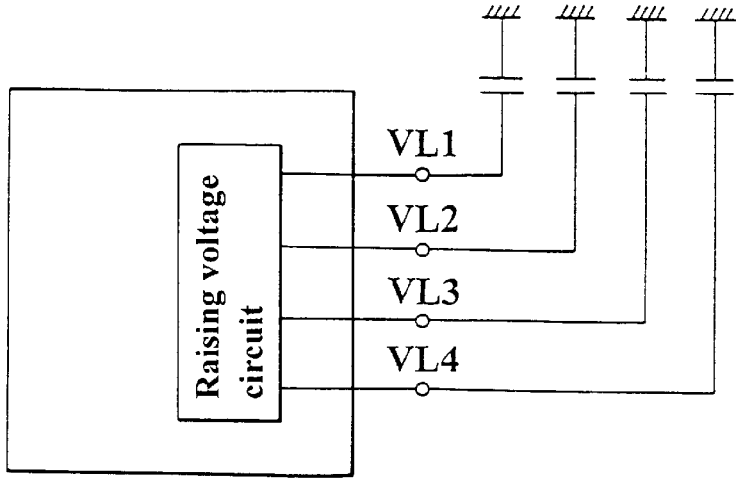
FIG.3(PRIOR ART)
FIG. 3 shows a configuration of installing capacitors for the conventional driving circuit for the liquid crystal display.
Figure 4:
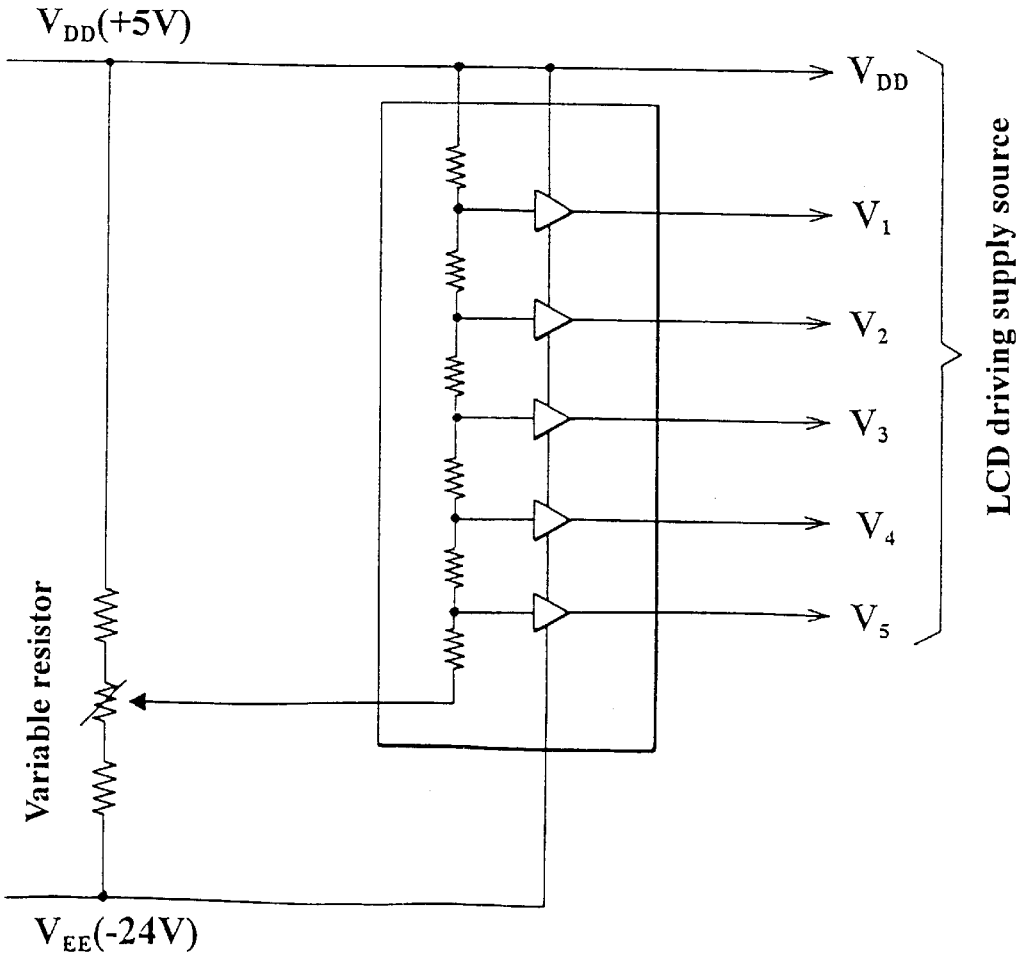
FIG.4(PRIOR ART)
FIG. 4 shows a conventional divided circuit with a plurality of resistors for the driving circuit for the liquid crystal display.
Figure 5:
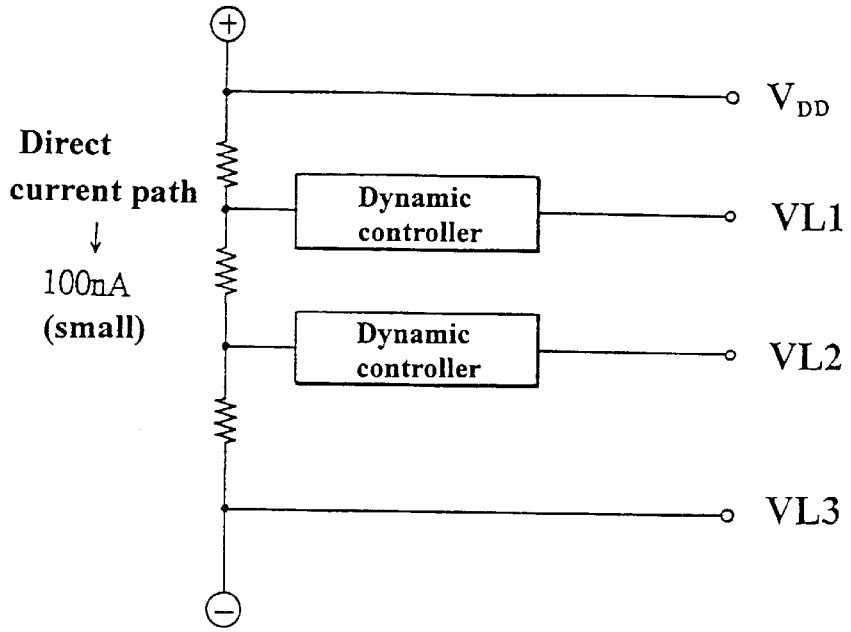
FIG. 5 shows a dynamic controller connected in the divided circuit with a plurality of resistor for the driving circuit for the liquid crystal display according to this invention.

The arrangement of dynamic controllers according to this invention is shown in FIG. 5. The input side of the dynamic controller is connected to the interconnection between two conjunct resistors of the conventional divided circuit with a plurality of resistors as shown in FIG. 4. In view of the current consumed in the dynamic controller according to this invention, each operating amplifier will consume 1.5 $\mu$A, and there is two operating amplifiers for consuming 3 $\mu$A. Each Schmitt comparator consumes 1 $\mu$A. Totally, the consuming current, that is 4 $\mu$A, can drive an area of 5 cm×5 cm of a liquid crystal display. It is clear that the driving current in this invention is only 40% of the conventional driving current, and the driven area according to this invention is about two and a half times of the conventional driven area as shown in FIG. 3. Thus, the goal of driving a larger area of the liquid crystal display with a smaller current is achieved. The object of further saving the power is achieved by timely emitting the power-on signal for enabling the dynamic controller such that the drawbacks of the conventional capacitor type and resistor type of the driving circuits can be solved.

Referring to FIG. 5, the driving circuit for the liquid crystal display according to this invention is to connect each input terminal of a plurality of dynamic controllers between the conjunct resistors of a resister type divided voltage circuit having a plurality of resistors, wherein the positive and negative terminals of the divided voltage circuit are respectively connected to the drain supply terminal and the source supply terminal of the driving circuit.

Figure 6:
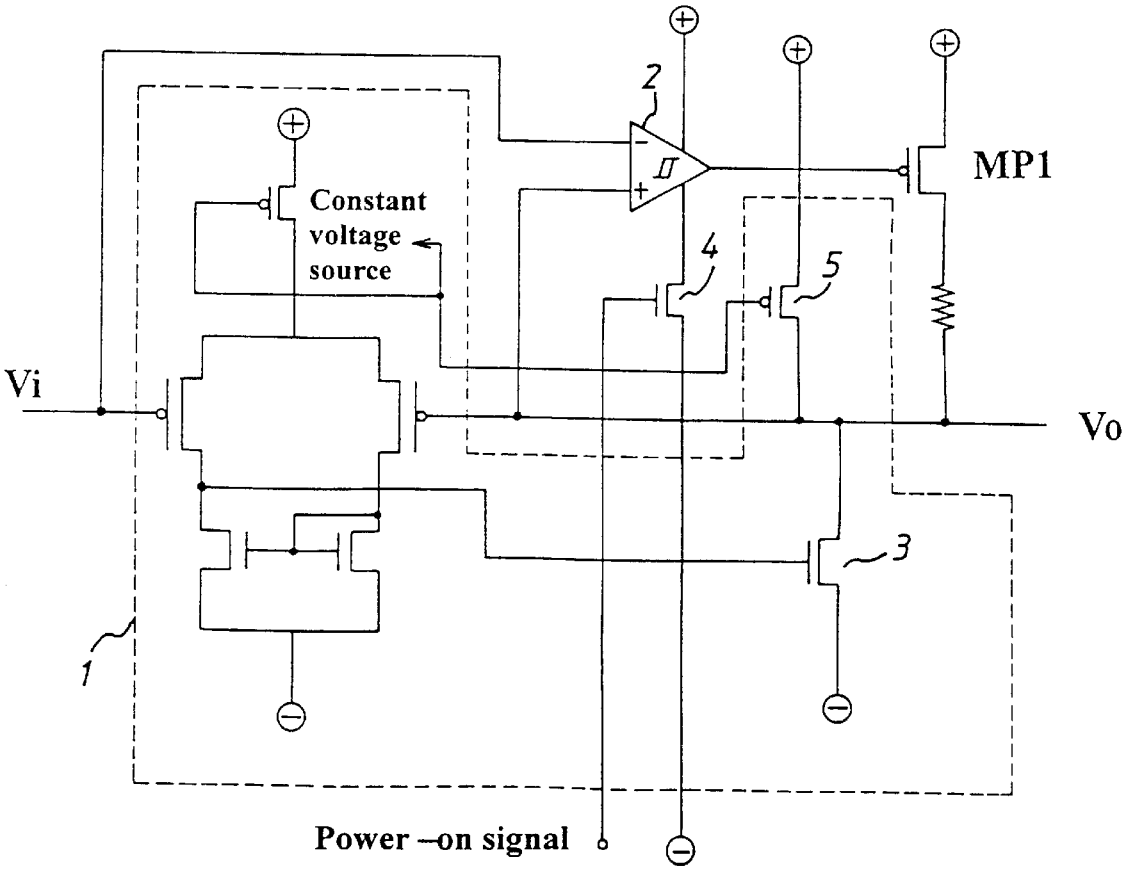
FIG. 6 is a circuit diagram of the dynamic controller of the driving circuit for the liquid crystal display according to this invention.

The detailed circuit diagram of the dynamic controller according to the embodiment according to this invention is shown in FIG. 6. The dynamic controller according to this invention mainly comprises an operating amplifier, a Schmitt comparator and a plurality of NMOS transistors used as switches. The dynamic controller is driven by a small current to keep the output voltage level equal to the input voltage level.

Referring to FIG. 6, the reference numeral 1 indicates a CMOS differential amplifier. The input voltage level (Vi) and the output voltage level (Vo) of the amplifier 1 are the voltage levels that this invention intends to keep them equal with each other. A first PMOS transistor 5 is connected to the output voltage terminal. The load of the CMOS differential amplifier 1 is a second PMOS transistor. The gate terminal of the first PMOS transistor 5 is connected to the gate terminal of the second PMOS transistor, both being supplied with a constant source voltage. The positive voltage shown in FIG. 5 could be in +3 volts. The reference numeral 2 in FIG. 6 is a Schmitt comparator. The two input terminals of the comparator 2 are respectively connected with the input voltage terminal and output voltage terminal of the dynamic controller. Two strobe terminals of the comparator 2 are respectively connected to the drain supply terminal and to the drain terminal of a second NMOS transistor 4 for acting as a switch. The source terminal and gate terminal of the second NMOS transistor 4 are respectively connected to the output terminal of the dynamic controller and to a power-on signal of the dynamic controller. The output terminal of the comparator 2 is connected to a gate terminal of a third PMOS transistor, also called MP1. The source terminal of the transistor MP1 is connected to the output voltage (Vo) terminal of the dynamic controller via a current control transistor. The reference numeral 3 in FIG. 6 indicates a first NMOS transistor. The drain terminal, source terminal, and gate terminal of the first NMOS transistor 3 are, respectively, connected to the output terminal of the dynamic controller, the source supply terminal of the dynamic controller, and the source terminal of the PMOS transistor of the CMOS differential amplifier 1, in which the gate terminal of the PMOS transistor is connected to the input terminal of the dynamic controller. In FIG. 6, the CMOS differential amplifier 1 (including the second PMOS transistor acting as a load), the first PMOS transistor 5, and the first NMOS transistor 3 are integrally called an operating amplifier (OP AMP) according to this invention.

The operation principle of the dynamic controller in the driving circuit for the liquid crystal display is as follows:

According to the dynamic controller in the preferred embodiment according to this invention, the CMOS transistor of the CMOS differential amplifier 1 of the operating amplifier has the characteristic feature that the current is only consumed at the moment of switching the input voltage level. Furthermore, the CMOS differential amplifier 1 is capable of transmitting the same input voltage level as the level at the output voltage terminal. Therefore, the CMOS differential amplifier 1 is able to keep the desired voltage in the output voltage terminal in a manner of consuming a rather small current by using the characteristic feature of the sink current and the Schmitt comparator when the input voltage level is varied. In other words, the output voltage level and the input voltage level can be kept equal with each other by a rather small driving current.

According to the dynamic controller in the preferred embodiment of the invention, when the input voltage level is varied by the change of the common signal or the segment signal, the principle of keeping the output voltage level the same as the input voltge level is as follows.

When the output voltage level (Vo) is higher than the desired voltage level, since the first NMOS transistor 3 is activated by the high output voltage level, the sink current in the first NMOS transistor 3 will immediately lower the output voltage level to the desired voltage level. On the other hand, when the output voltage level is lower than the input voltage level, since the Schmitt comparator will compare the value of the output voltage level with that of the input voltage level and at this moment will decide that the output voltage level of the Schmitt comparator should be in the output voltage level so as to enable the third PMOS transistor MP1, therefore, the output voltage level is raised to the proper higher voltage level.

Figure 7:
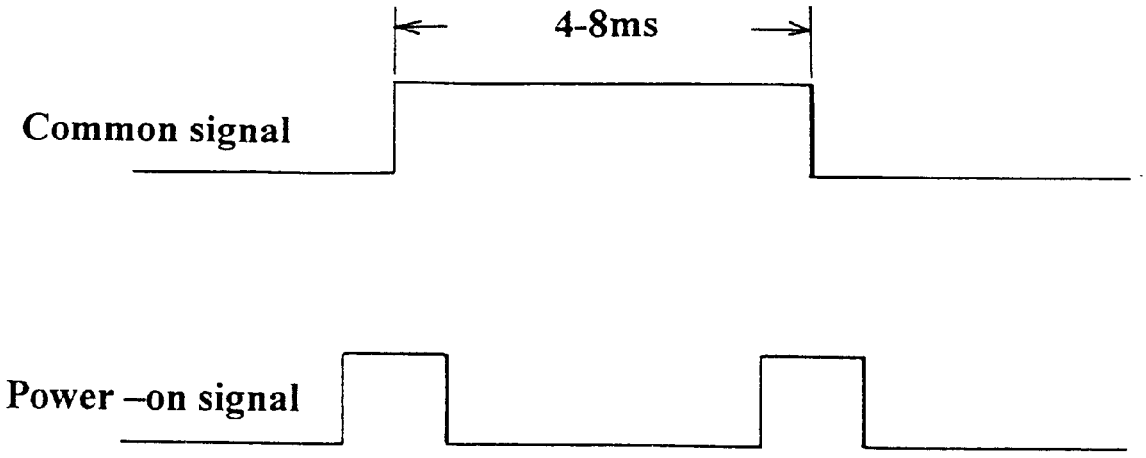
FIG. 7 shows a timing diagrams of the power-on signal and the common signal for the Schmitt comparator of the dynamic controller of the driving circuit for the liquid crystal display according to this invention.

Furthermore, in the preferred embodiment according to this invention, in order to further save the power, the power-on signal of the dynamic controller according to this invention can be activated once at the period before and after while each common signal of the liquid crystal display is to be activated. The reason for only emitting the power-on signal once in the period of changing the level of the common signal is that the output voltage level of the dynamic controller varies once when each of the common signals is changed, as shown in FIG. 7.

Although the present invention and its advantages have been described in detail, it should be understood that various changes, substitutions and alterations, such as changing the N-type substrate according to this invention to the P-type substrate, can be made without departing from the spirit and scope of the invention as defined by the appended claims.

What is claimed is:

1. A driving circuit for a liquid crystal display, comprising a plurality of dynamic controllers, each dynamic controller comprising:

an operating amplifier including a CMOS differential amplifier, a first PMOS transistor (5) and a first NMOS transistor (3), wherein a load of the CMOS differential amplifier is a second PMOS transistor, a gate terminal of the second PMOS transistor and a gate terminal of the first PMOS transistor are connected with each other with the supply of a constant source voltage thereto, drain terminals of the first and second PMOS transistors are both connected to a drain supply voltage terminal of the dynamic controller, a source terminal of the first PMOS transistor and a drain terminal of the first NMOS transistor are both connected to an output voltage (Vo) terminal of the dynamic controller, and source terminals of the first NMOS transistor and the CMOS differential amplifier are both connected to a source power voltage terminal of the dynamic controller; and a Schmitt comparator of which a positive comparing terminal and a negative comparing terminal are connected to the output voltage (Vo) terminal and an input voltage (Vi) terminal of the dynamic controller, respectively, an output voltage terminal of the comparator is connected to a gate terminal of a third PMOS transistor (MP1) acting as a switch, the gate terminal of the third PMOS transistor is connected to the drain supply voltage terminal of the dynamic controller, a source terminal of the third PMOS transistor is connected to the output voltage (Vo) terminal via a current control resistor, two strobe terminals of the Schmitt comparator are connected to the drain supply voltage terminal of the dynamic controller and a drain terminal of a second NMOS transistor, respectively, and a gate terminal and a source terminal of the second NMOS transistor are connected to a power-on signal terminal and the output voltage (Vo) terminal of the dynamic controller, respectively.

2. A driving circuit for a liquid crystal display claimed in claim 1, wherein a power-on signal of the dynamic controller is activated at the period before and after while each common signal of the liquid crystal display is to be activated.

3. A driving circuit for a liquid crystal display claimed in claim 1, wherein a power-on signal of the dynamic controllers is activated at the period before and after while each common signal of the liquid crystal display is to be activated, and a drain terminal, a gate terminal and a source terminal of a N-MOS transistor is connected with the output voltage terminal of the circuit, a source terminal of input-side P-MOS transistor of an operating amplifier, and a source power voltage terminal.

4. A driving circuit for a liquid crystal display, comprising a plurality of dynamic controllers, each dynamic controller including an operating amplifier, a Schmitt comparator and a plurality of transistors acting as switches for keeping an output voltage level of the dynamic controller equal to an input voltage level of the dynamic controller, wherein a power-on signal of the dynamic controllers is activated at the period before and after while each common signal of the liquid crystal display is to be activated.

5. A driving circuit for a liquid crystal display, comprising a plurality of dynamic controllers, each dynamic controller including an operating amplifier, a Schmitt comparator and a plurality of transistors acting as switches for keeping an output voltage level of the dynamic controller equal to an input voltage level of the dynamic controller, wherein a power-on signal of the dynamic controllers is activated at the period before and after while each common signal of the liquid crystal display is to be activated, and a drain terminal, a gate terminal and a source terminal of a N-MOS transistor is connected with the output voltage terminal of the circuit, a source terminal of input-side P-MOS transistor of an operating amplifier, and a source power voltage terminal.

* * * * *